US005164688A

United States Patent [19]

Larson

[11] Patent Number: 5,164,688

[45] Date of Patent: Nov. 17, 1992

[54] MINIATURE MICROWAVE AND MILLIMETER WAVE TUNER

[75] Inventor: Lawrence E. Larson, Santa Monica, Calif.

[73] Assignee: Hughes Aircraft Company, Los Angeles, Calif.

[21] Appl. No.: 708,955

[22] Filed: May 31, 1991

[51] Int. Cl.[5] ..... H01P 5/04

[52] U.S. Cl. ..... 333/33; 333/205; 333/246; 333/263

[58] Field of Search ..... 333/33, 205, 246, 263; 200/181

[56] References Cited

U.S. PATENT DOCUMENTS 4,096,453 6/1978 Rogers ..... 333/246 X
4,472,690 9/1984 Hallford ..... 333/35
4,716,389 12/1987 Gawronski et al. ..... 333/81 A
4,906,956 3/1990 Kakihana ..... 333/263 X
4,922,253 5/1990 Nathanson et al. ..... 200/181 X
5,043,043 8/1991 Howe et al. ..... 156/645

*Primary Examiner*—Paul Gensler
*Attorney, Agent, or Firm*—E. E. Leitereg; W. K. Denson-Low

[57] ABSTRACT

A miniature, electrostatically actuated, stub tuner which is operable to dynamically tune a transmission line in response to control signals. With the use of integrated circuit processing the transmission line is fabricated on a substrate and at least one stub tuner is fabricated over the substrate and is movable relative to the transmission line in response to electrostatic fields produced when the control signals are selectively applied to rows of control electrodes.

21 Claims, 4 Drawing Sheets

MINIATURE MICROWAVE AND MILLIMETER WAVE TUNER

BACKGROUND OF THE INVENTION

1. Field Of The Invention

This invention relates generally to electronic tuners and more particularly to miniature dynamic stub tuners of a type that can be fabricated on integrated circuit substrates.

2. Description Of The Related Art

With integrated circuit technology, size and space are a serious constraint on circuit designers. For example, very small dimensioned, thin film transmission lines are fabricated directly onto the surface of a dielectric substrate. Very often these transmission lines have different characteristic impedances than the circuit elements to which they are coupled. Since it has been difficult to utilize variable tuners for impedance matching because of the small dimensions involved and the density of circuit elements, such lines have typically been tuned to a fixed impedance match.

Unfortunately, the circuit device impedances change with normal variations in the processed integrated circuit. Consequently, the impedance match can be lost. As a result of the fixed nature of the typical transmission line tuning, the resulting operating flexibility and performance of the integrated circuit is undesirably affected.

These challenges have often been met by the use of active semiconductor devices for circuit tuning purposes. The use of active semiconductor devices for such tuning is described by I. Bahl and P. Bhartia in *Microwave Solid-State Circuit Design,* John Wiley & Sons (1988), pages 373 through 422. While these types of devices are characterized by their small sizes, they do present other challenges to the circuit designer. For example, they typically introduce significant losses and have limited ranges and power handling capabilities.

With the advent of micro-machining it has been shown that it is feasible to fabricate mechanical and electromechanical devices using thin film integrated circuit technology. Some specific examples are the levers, gears, sliders, and springs referred to in U.S. Pat. No. 4,740,410, issued on Apr. 26, 1988, to R. S. Muller et. al., and entitled *Micro Mechanical Elements and Methods for Their Fabrication.* In addition, electromechanical devices such as rotatable motors and linear motors are described in U.S. Pat. No. 4,754,185, issued on June 28, 1988 to K. J. Gabriel et. al., and entitled *Micro-Electrostatic Motor.*

SUMMARY OF THE INVENTION

In meeting the challenges mentioned above, the present invention is embodied in a micro-machined, electrostatically actuated, dynamic stub tuner fabricated on a dielectric substrate of an integrated circuit chip by the use of integrated circuit processing technology. Specifically, a fixed transmission line is fabricated on the surface of the substrate. In addition, a movable tuning stub is fabricated on the substrate such that it can be electromechanically moved relative to the fixed transmission line. The stub thus affects the effective length and characteristic impedance of the transmission line and thereby tunes the transmission line and matches it to the associated circuit elements to which it is coupled. Various embodiments include, for example, distributed stub tuners and tunable bandstop filters.

There are numerous advantages to such dynamic tuners. Among them are that the tuners can be batch fabricated on an integrated circuit chip utilizing the same integrated circuit processing techniques that the associated integrated circuits are fabricated with. Thus, at the same time that integrated circuits are being fabricated, stub tuners can be fabricated that take up very little space on the wafer, add very little weight, and are easily replicated. Moreover, the stub tuner can be positioned closer to the associated circuit elements than would be the case if the tuner were positioned off of the wafer, thereby reducing long line effects. In addition, the stub tuner has a wide dynamic range in the microwave and millimeter wave bands and exhibits very little power loss when performing the tuning. Furthermore, the stub tuner can be adjusted electro-mechanically on the wafer with very low power control signals. The stub tuner is also radiation hardened.

By fabricating such dynamic tuners in place on the integrated circuit it is now possible to tune the circuit after fabrication, thereby enhancing the circuit yield of good circuits and thus lowering the manufacturing costs. In addition, the described tuners are believed to have a wider dynamic range and lower insertion loss at microwave and millimeter wave band operation than other known tuners.

DESCRIPTION OF THE PREFERRED EMBODIMENTS

Figure 1:
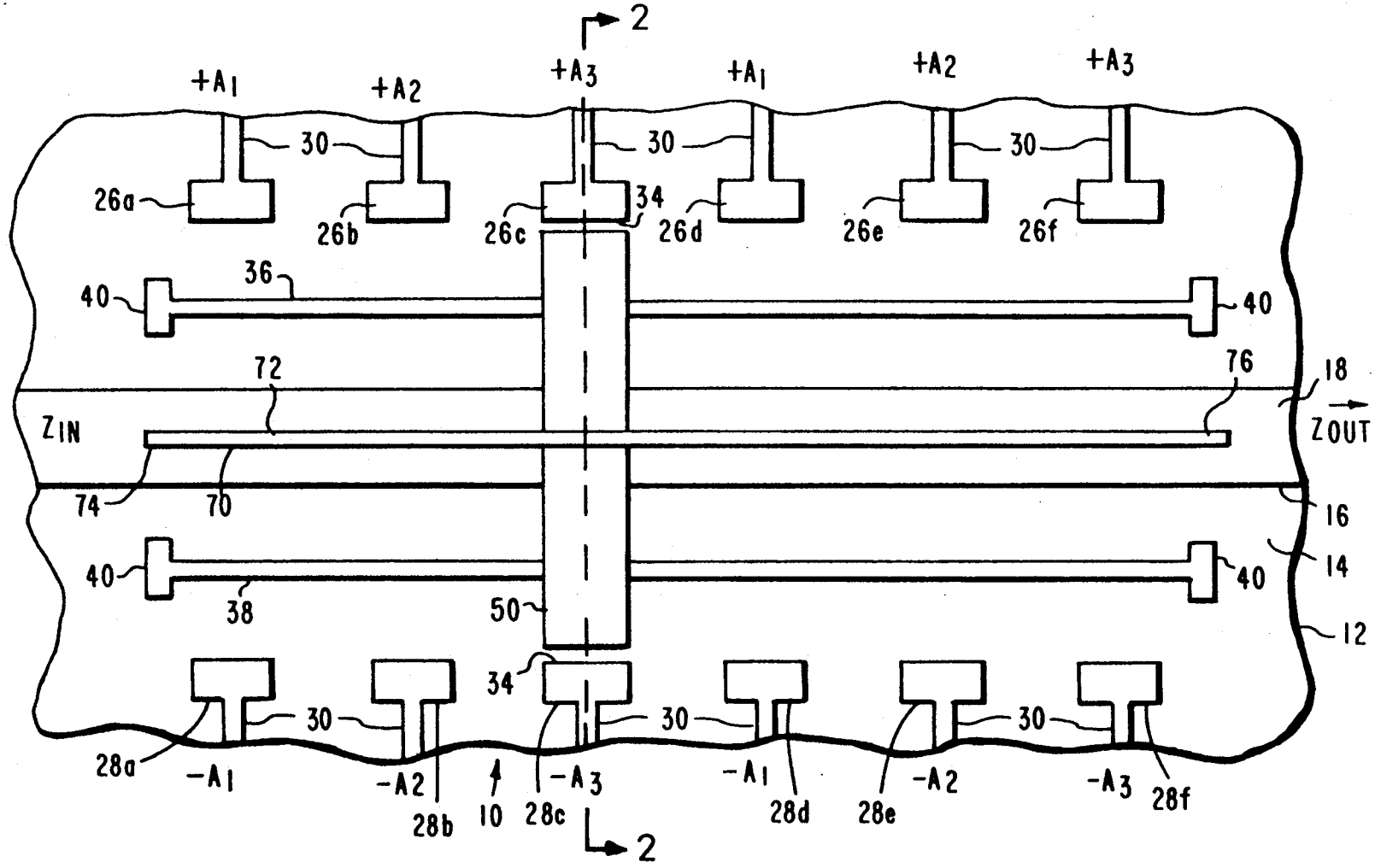
FIG. 1 is a top plan view of a single stub tuner illustrating a transmission line and a tuning stub which is operably translated along the long axis of the transmission line by control signals to tune the transmission line.

Referring now to the drawings in more detail, as illustrated in the top plan view of FIG. 1 a single stub tuner 10 is fabricated on the surface of a substrate 12 utilizing, for example, thin film integrated circuit manufacturing techniques such as the photoresist, masking, deposition, plating, selective etching, and chemical milling techniques described in U.S. patent application Ser. No. 07/608,139, filed on Nov. 1, 1990, now U.S. Pat. No. 5,121,089, by Lawrence E. Larson, and entitled *Micro-Machined Switch & Method Of Fabrication.* Of course, other techniques could also be used to fabricate the stub tuner.

Hereinafter when the term "thin film" is used it should be understood it means films typically deposited by plating, sputtering, evaporation, or vapor deposition and having a typical thickness, by way of example but not limitation, of less than about 10 microns.

The substrate 12 is made of a dielectric and has a smooth, flat surface 14. Preferably the substrate is made of gallium-arsenide since it is an excellent dielectric for microwave and millimeter wave applications, and semiconductor devices and passive circuit components can be fabricated on it. It is believed that other materials such as, for example, silicon, sapphire, or indium-phosphide would be appropriate.

Figure 2:
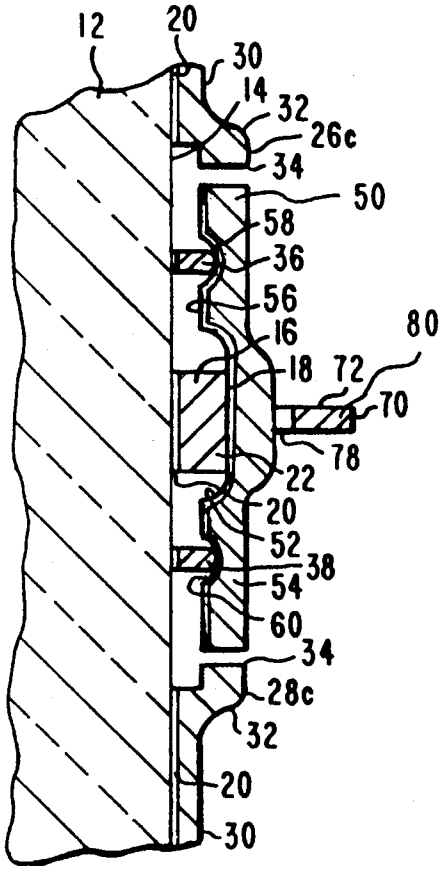
FIG. 2 is a side elevation view of the tuner of FIG. 1 taken along the plane 2—2 of FIG. 1, illustrating the relationship between the tuning stub, the transmission line and a pair of stator control electrodes.

A transmission line 16 is fabricated on the surface 14 of the substrate using photoresist, masking, selective etching, and thin film metalization processes. This segment of the transmission line 16 is generally linear, has a rectangular cross section and has a flat smooth top surface 18, as is best illustrated in FIG. 2. Hereinafter when the relative descriptive terms "top" and "bottom" are used it should be understood that "top" is relative to the top surface 14 of the substrate 12 and faces outward from the plane of the top plan drawings such as FIG. 1. Structurally, the transmission line 16 includes a first layer 20 of titanium about 500 A thick and gold about 4500 A thick deposited on the substrate surface 14. Titanium is used because it bonds very well to gallium arsenide. A layer 22 of electrically conductive material such as gold, for example, is plated on top of the layer 20. This layer can be about 1 to 2 microns thick and is preferably deposited by electro plating. The width of the transmission line is, for example, 50 microns.

Two rows of stator control electrodes 26*a* through 26*f* and 28*a* through 28*f* respectively of electrically conductive material are disposed along opposite sides of the transmission line 16 such that the end wall pole face 34 of each stator control electrode is displaced laterally the same distance from the side wall of the transmission line 16 so that the pole faces are in the same planes. The width and height of these pole faces 34 are about the same width and height as that of a movable tuning stub 50 which will be described in more detail subsequently, and the spacing between them can, for example, be about the same as the width of the control electrodes. Control leads connect each of the control electrodes 26*a*–26*n* and 28*a*–28*n* to a source of control signals (not shown).

Each control electrode 26*a* through 26*f* is aligned along an axis oriented at a right angle to the transmission line 16 so that it is in alignment with a corresponding one of the control electrodes 28*a* through 28*f* on the opposite side of the transmission line and can be considered a pair with this other control electrode. For example, control electrodes 26*a* and 28*a* are considered a pair. As will be explained in more detail with regard to the operation of the stub tuner 10, each control electrode pair operably generates an electrostatic field when control signals +A1 and −A1 et seq. of different signal levels are applied to them.

As is best illustrated in FIG. 2, each control electrode such as 26*c* and 28*c* are fabricated from the thin layer of titanium and gold 20 and the thicker layer of gold 22 that the transmission line 16 is fabricated from. The thickness of the control electrodes can be about the same thickness as the thickness of the tuning stub 50. A web portion 32 projects from the surface 14 of the substrate 12 and holds a control electrode in a "goose neck" configuration such that the pole face 34 of each stator control electrode is displaced above the surface 14 a distance about equal to the distance that the tuning stub 50 is disposed above the surface 14. Consequently, the face 34 of each control electrode will be congruent with the end walls of the tuning stub 50 when the axis of the tuning stub is in alignment with a control electrode pair.

Guide means for the tuning stub 50 such as guide rails 36 and 38 are formed on the surface 14 of substrate 12 on opposite sides of the transmission line 16. These rails 36 and 38 are each disposed along an axis that is between and parallel to the axis of the transmission line 16 and to the plane of the pole faces of the control electrodes 26*a*–26*n* and 28*a*–28*n*.

As is best illustrated in FIG. 2, the rails 36 and 38 are formed on the substrate surface 14 and can be fabricated of a variety of materials. For example, they can consist of the thin layer of titanium and gold 20 and layer of gold 22, or they can be fabricated from dielectrics such as SiO or SiN. In practice, the surfaces of the rails are smooth and their cross sections can be rectangular, triangular rounded, etc. The height of the rails 36 and 38 is preferably about the height of the control electrodes and the width is a matter of choice. The lengths of the rails 36 and 38 are sufficient to extend it beyond the ends of the rows of control electrodes.

Disposed at each end of each rail 36 and 38 is a stop member 40 having an enlarged cross sectional area relative to the cross sectional area of the rails 36 and 38. These stop members 40 operate to limit travel of a tuning stub 50.

The tuning stub 50 is generally elongate and rectilinear and is formed over the substrate surface 14 such that the stub's long axis is oriented transversely at a right angle to the long axis of the transmission line 16. Through the use of photoresists, masking, selective etching and metalization, this tuning stub 50 configured so that it is not bonded to the substrate 12 or other elements of the tuner when all of the photo resist is removed but is free to move relative to the fixed transmission line 16.

The tuning stub 50 is fabricated of the thin layer of titanium and gold 20 and a layer 54 of electrically conductive material such as gold. The stub 50 can, for example, be 2–5 microns thick, 50 microns wide, and 200 to 300 microns long.

The end walls of the stub 50 are generally flat and disposed in a plane parallel to the plane of each of the pole faces 34 of the control electrodes 26*a*, 28*a*, etc. An air gap of between 1.0 and about 5.0 microns exists between the pole faces and the end walls of the stub 50. The narrower the air gap, the stronger the electrostatic field attraction will be between the control electrodes and the tuning stub.

The bottom surface 56 of the stub 50 closest to the substrate surface 14 has a pair of spaced apart guide slots 58 and 60 formed in it by the previously referred to photoresist and selective etching techniques. These guide slots are spaced to correspond to the spacing of the guide rails 36 and 38 and are configured to nest over the guide rails in low friction sliding relationship. When the tuning stub 50 is so positioned on the guide rails 62 and 38, the surface of the bowed up center portion 52 of the stub 50 contacts the top surface 18 of the transmission line and is operable to slide along it with low friction.

In order to keep the stub tuner 50 on top of the transmission line 16, a retaining means 70 is fabricated to extend over the transmission line in an air bridge configuration. A retaining bar 72 is secured at both ends to the transmission line 16 by pillars 74 and 76. One end of each pillar is secured to the bar 72 and the other end of the pillars is secured to the transmission line 16. The spacing between each pillar 74 and 76 is longer than the length of each row of control electrodes 26*a*–26*n* and 28*a*–26*n*. As a result, when the stub tuner 50 travels beyond the control electrodes it is stopped by the pillar 74 or 76 and the stub's travel is limited. The clearance between the transmission line surface and the bar 72 is large enough to allow the stub to travel along the transmission line without binding restriction.

As illustrated in FIG. 2, the retaining bar 72 can have a rectangular cross section and is of sufficient height and width to provide sufficient structural strength to retain the stub tuner on top of the transmission line 16. The material used for the retaining member 70 can include the thin layer 78 of titanium and gold and the thicker layer 80 of gold similar to the corresponding layers previously discussed with regard to the other elements of the tuner 10.

In operation, pairs of control signals: +A1 and −A1; +A2 and −A2; and +A3 and −A3 are sequentially applied to the control electrode pairs 26*a*–28*a*, 26*b*–28*b*, 26*c*–28*c*, et. seq. In practice, the control signals +A will have a higher voltage potential than the control signals −A. These control signals set up an electrostatic field on each of the control electrodes which develop an electrostatic image charge of opposite polarities relative to each other at each end of the tuning stub 50 adjacent to the control electrodes. The electrostatic attraction between the fields of the control electrodes and the charges on the ends of the stub 50 effectively translate the tuning stub 50 along the axis of the transmission line 16. To move the stub 50 from left to right relative to the drawing or away from the signal input end of the transmission line 16, the sequence of control signal pairs will be A1, A2, A3, A1, A2, etc.

Assuming, for example, that the tuning stub 50 were in alignment with the control electrode pair 26*a* and 28*a*, with a control signal pair sequence A1, A2, A3 the tuning stub 50 will be effectively stepped to the right to a position in which its axis is in alignment with the stator control electrode pair 26*c* and 28*c* as illustrated in FIG. 1. If, however, the tuning stub 50 is to be stepped from the far right to the left, the sequence of control signal pairs applied to the stator control electrodes will be reversed to A3, A2, A1, A3. As a result of the electrostatic fields and attractions, the tuning stub 50 translates from right to left to stop in alignment with the control electrode pair 26*c* and 28*c*, as illustrated in FIG. 1.

Finer tuning of the stub 50 can also be accomplished in a number of ways. For example, a vernier effect can be attained in which the tuning stub can be translated to a position midway between adjacent control electrode pairs. This is done by simultaneously applying two control signals pairs such as +A2 and −A2 to electrodes 26*b* and 28*b*, and control signals +A3 and −A3 to electrodes 26*c* and 28*c*. The equilibrium point for the electrostatic attraction between the control electrodes and the tuning stub 50 is thus between the adjacent control electrode pairs; and consequently the tuning stub 50 comes to rest midway between such adjacent control electrodes.

Even finer tuning of the stub 50 can be performed by selectively applying control signals +A and −A of different amplitudes to adjacent pairs of the control electrodes. As a result, the equilibrium point of the electrostatic field will positioned nearer to one of the adjacent pairs of control electrodes than the other adjacent pair. For example, if the control signals +A3 and −A3 have a higher amplitude than the control signals +A2 and −A2, the equilibrium point will be closer to the control electrodes to which the higher amplitude control signals +A3 and −A3 is applied.

As the stub 50 is thus translated and repositioned along the axis of the transmission line 16, the characteristic impedance and effective length of the transmission line is tuned to more closely match the impedances of the circuitry to which the transmission line 16 is coupled.

Other stub tuners can be fabricated utilizing the principles described herein. For example, a double stub tuner 100 illustrated in FIGS. 3 and 4 includes a transmission line 102 fabricated on a flat surface 104 of a substrate 106. In operation, each one of tuning stubs 108 and 110 can be independently translated along its long axis at a right angle to the axis of the transmission line 102 to vary the effective length of each stub 108 and 110. As a result, the effective length and characteristic impedance of the transmission line 102 can be dynamically tuned on the integrated circuit after fabrication.

Figure 4:
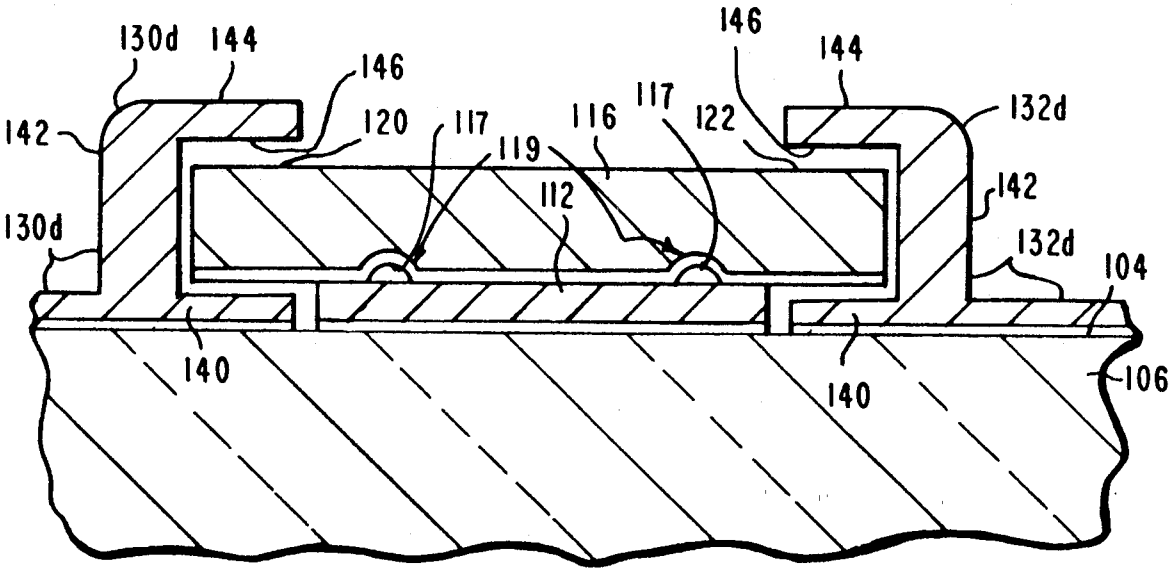
FIG. 4 is an enlarged side elevation cross section view taken along the plane 4—4 of FIG. 3, illustrating the relationship between a movable stub, a fixed stub, and a pair of control electrodes.
Figure 3:
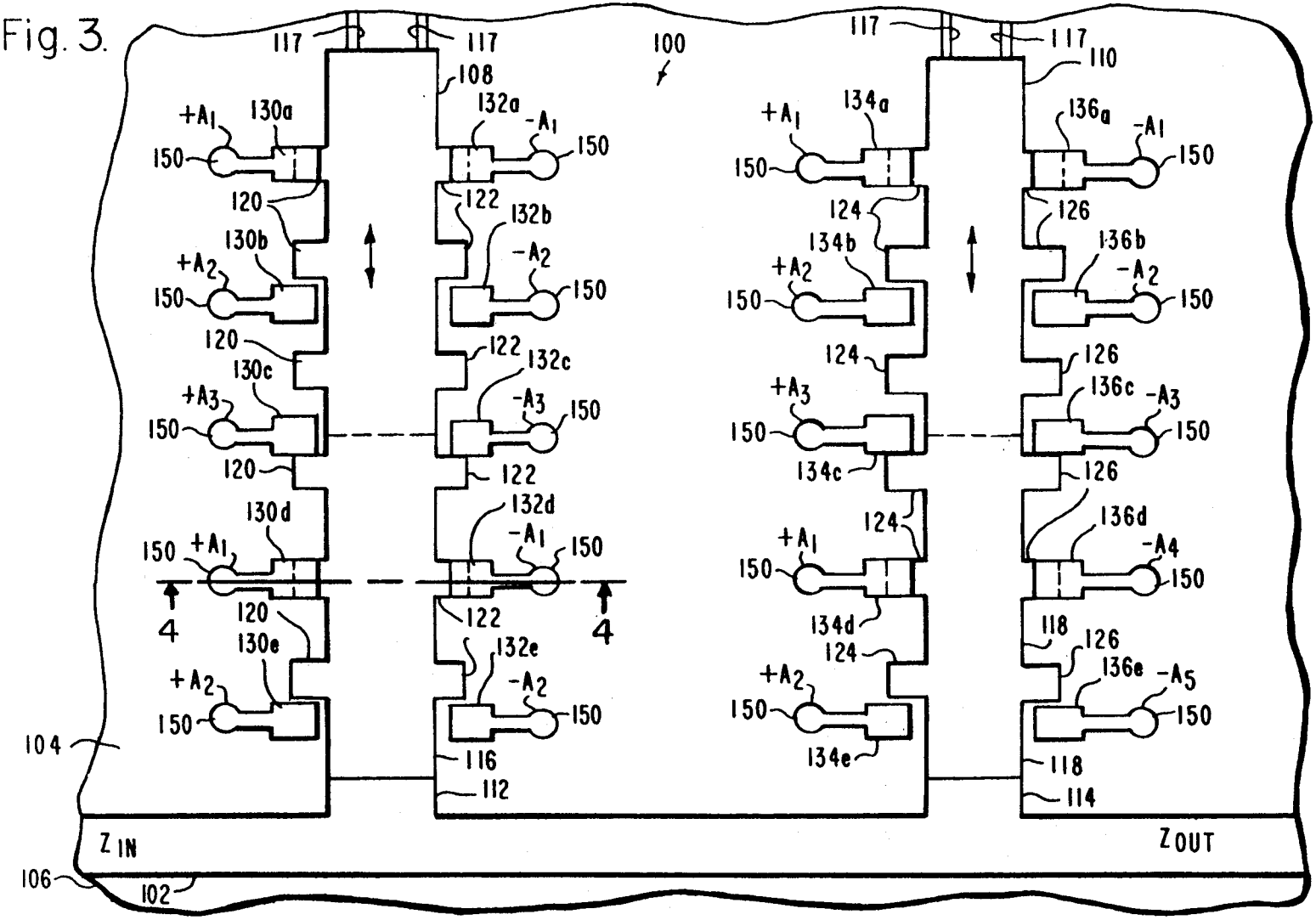
FIG. 3 is a top plan view of a double stub tuner in which the tuning stubs are translated along their long axes laterally relative to the axis of the transmission line to operably lengthen and shorten the stubs and thus tune the transmission line.

Referring now to FIGS. 3 and 4 in more detail, the transmission line 102 of electrically conductive material is fabricated on the surface 104 in the same manner as the transmission line 16 was fabricated in FIGS. 1 and 2.

Deposited on one edge of the transmission line 102 and projecting therefrom at a right angle to its long axis are two spaced apart fixed stubs 112 and 114 which are generally rectilinear in configuration and form a portion of each of the tuning stubs 108 and 11 respectively. These fixed stubs 112 and 114 are integral with the transmission line 102, are of the same material, and are patterned and fabricated with it. They are also the same thickness as the transmission line 102. Moreover, the exposed top surfaces of the transmission line 102 and the fixed stubs 112 114 are smooth, flat and preferably coplanar.

Movable stubs 116 and 118 of electrically conductive material are fabricated above the planar surface of the fixed stubs 112 and 114. Each of these movable stubs 116 and 118 are generally rectilinear in configuration and operate as a part of the tuning stubs 108 and 110 respectively. The abutting surfaces of both the fixed stubs 112 and 114 and the movable stubs 116 and 118 are smooth and allow low friction movement between them.

The movable stubs 116 and 118 translate along their long axes toward and away from the transmission line along a path that is at a right angle to the long axis of the transmission line. Guide rails 117 similar in structure to the guide rails 36 and 38 of FIG. 1 are fabricated on the substrate 106 along paths that are parallel to the long axes of the movable stubs 116 and 118. A pair of spaced apart guide slots 119 (FIG. 4) are formed in the bottom surface of the movable stubs 116 and 118 and receive the guide rails 117 to operably keep the moveable stubs planar to the surface of the substrate 106 and to guide them along their axes.

Disposed along each side wall of the moveable stubs 116 and 118 are a series of evenly spaced apart tabs 120, 122, 124, and 126 which project laterally from the side wall relative to the long axes of the stubs 116 and 118. The tabs 120 and the tabs 122 are associated with movable stub 116; and the tabs 124 and 126 are associated with movable stub 118. These tabs are fabricated as a part of the movable stubs using integrated circuit processing techniques such as those referred to herein.

Disposed along each side of movable stubs 116 and 118 are a row of spaced apart stator control electrodes 130*a* 130*e*, 132*a*–132*e*, 134*a*–134*e*, and 136*a*–136*e*. The control electrodes 130*a*–130*e* and 132*a*–132*e* are associated with moveable stub 116 while the control electrodes 134*a*–134*e* and 136*a*–136*e* are associated with the movable stub 118.

Referring now to FIG. 4, which is a cross section view taken along the plane line 4—4 in FIG. 3, each control electrode, such as 130*d* and 132*d*, is generally " U " shaped in cross section having a base 140 which is fabricated on the surface 104 of the substrate 106. The thickness of the base 140 is less than the distance that the bottom surface of the movable stubs 116 and 118 are displaced above the surface of substrate 106. A web 142 extends up from the base 140 in a direction away from the substrate 106. From the free end of web 142 a tongue 144 projects over the tabs 120 and 122. This structure forms a "U" shaped pole face 146 that partially overlaps the tabs 120 and 122 with an air gap between the tabs and the pole faces. As a result of such overlap and a spacing between adjacent control electrodes of 5/4 of the spacing between adjacent tabs 120, 122, 124, or 126, at least two pairs of the control electrodes overlap two pair of tabs 120, 122, 124, and 126 at any time. For example, in FIG. 3 the control electrodes pair 130*a*–132*a* overlap tabs 120 and 122 respectively while control electrode pair 130*d*–132*d* overlap tabs 120 and 122. The tabs 120 and 122 are free to travel through the channel formed by the "U" shaped pole faces in the control electrodes.

When control signals are applied to the control electrodes via leads from pads 150 a significant electrostatic attraction is created between the control electrodes and the image charge induced on the tabs to effect translation of the moveable stub along its long axis. For example, control signal sequence +A1 and −A1, +A2 and −A2, +A3 and −A3, etc. will translate the movable stub 116 or 118 toward the transmission line 102. This shortens the length of the tuning stub 108 or 110. Conversely, a reversal of the sequence of control signals to +A3 and −A3, +A2 and −A2, +A1 and −A1 et seq. will translate the movable stub 116 or 118 away from the transmission line 102 to lengthen the tuning stubs 108 and/or 110. Such varying of the lengths of tuning stubs 108 and 110 operably tunes the transmission line 102 by varying its characteristic impedance and effective length.

Figure 5:
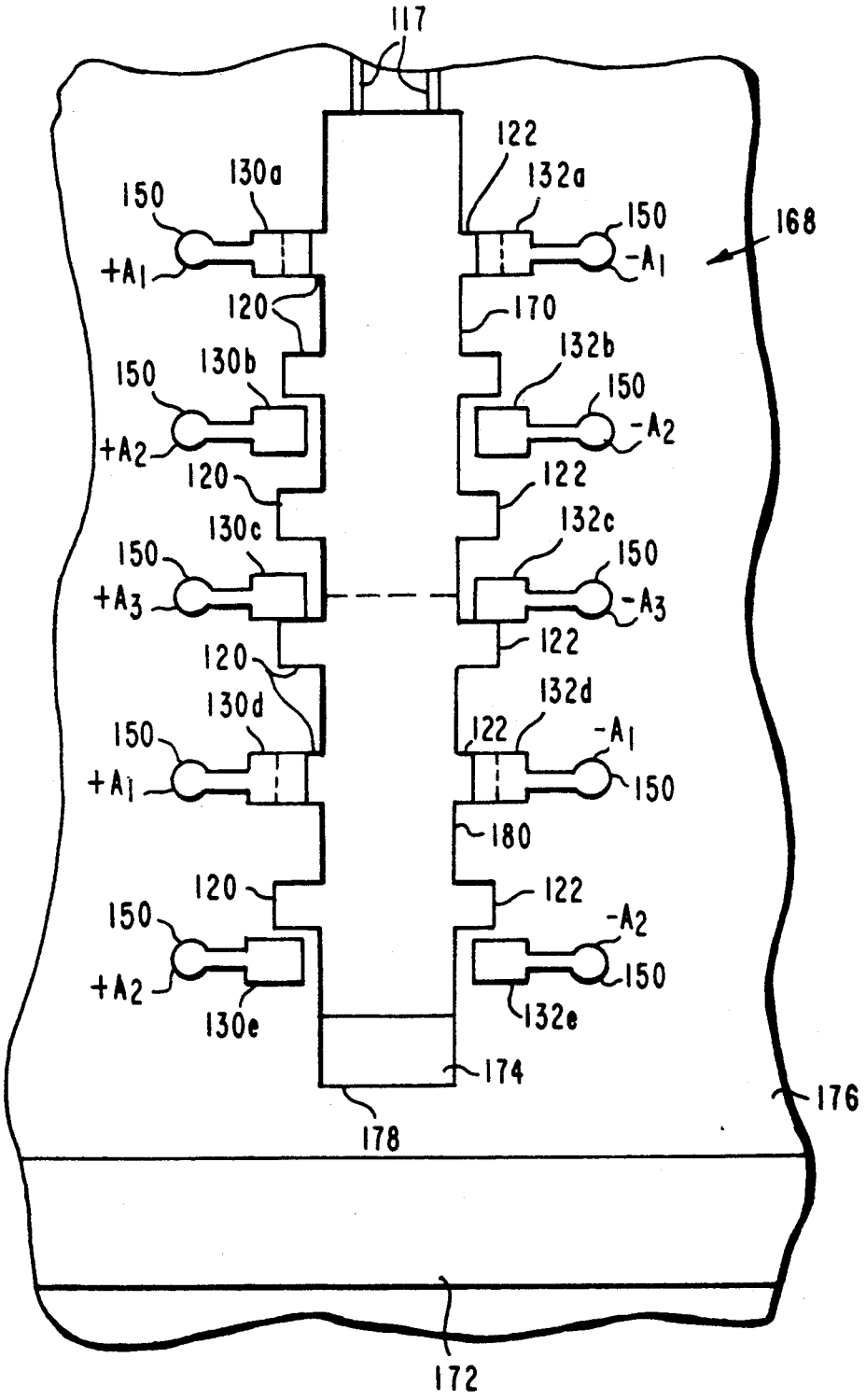
FIG. 5 is a top plan view of a tunable bandstop filter having a movable stub which operably translates laterally relative to the long axis of a transmission line to effectively vary the stub length and thus tune the band pass of the transmission line.

Another embodiment of a stub tuner is configured as a tunable bandstop filter 168 in FIG. 5. In this bandstop filter 168 a tunable stub 170 is translated along its long axis at a right angle to the axis of a transmission line 172. A fixed stub 174 is fabricated on a substrate 176 with a gap between one end 178 of the fixed stub 174 and the side wall of the transmission line 172. As in the stub tuner of FIG. 3, a movable stub 180 is fabricated to ride along the guide rails 117 to slide over the top of the fixed stub 174 to effectively lengthen and shorten the tunable stub 170. Such changes in the length of the stub is coupled to the transmission line 172 by changing the electrical field across the gap and thus changing the characteristic impedance of the transmission line 172.

Since the general electro-mechanical operation of the tunable stub 170 of the bandstop filter 168 of FIG. 5 is similar to the operation of the tunable stub 108/110 of the double stub tuner of FIG. 3, the same structural elements are identified with the same reference characters in both FIGS. Thus, the operation of shortening and lengthening the tunable 170 stub can understood by referring to the preceding portion of this detailed description.

As previously stated, all of the embodiments described herein are fabricated by integrated circuit processes using the same described materials. For example, each of the transmission lines, the tunable stubs, and the stator control electrodes are preferably fabricated of electrically conductive materials such as a thin layer of titanium and gold and thicker layers of gold, each patterned on the substrate using layers of photoresist patterned by masking, photoexposure, selective etching, and metalization.

Moreover, while gold is the preferred material for the structural elements it believed that other electrically conductive materials can be used. Accordingly it should, by way of example but not limitation, be possible to use stainless steel, doped silicon, and rhodium. Moreover, it should again be possible to use materials other than gallium arsenide for the substrate.

While salient features have been described with respect to particular embodiments, many variations and modifications can be made without departing from the scope of the invention. Accordingly, that scope is intended to be limited only by the scope of the appended claims.

What is claimed is:

1. A miniature, electrostatically actuated, tunable circuit comprising:

a substrate having a transmission line disposed at one surface thereof;

at least one tuning stub means of electrically conductive material formed above said transmission line, said tuning stub being movable relative to said transmission line; and control means fabricated on said one surface of said substrate and being operable to selectively receive control signals for producing electrostatic fields which are coupled to said tuning stub, said electrostatic fields being operable to move said tuning stub means relative to the axis of said transmission line and operably tune said transmission line.

2. The miniature, electrostatically actuated, tunable circuit of claim 1 in which said control means is disposed with an air gap that is sufficiently narrow such that the control means will induce an image charge on said tuning stub means to enhance electrostatic attraction.

3. The miniature, electrostatically actuated, tunable circuit of claim 1 in which said control means includes a plurality of separate control electrodes distributed on at least one side of said transmission line.

4. The miniature, electrostatically actuated, tunable circuit of claim 3 in which said separate control electrodes are distributed along both sides of said transmission line and are operable to move said tuning stub means along the axis of said transmission line to operably tune said transmission line.

5. The miniature, electrostatically actuated, tunable circuit of claim 3 in which said separate control electrodes are distributed along paths that are disposed at an angle to the axis of said transmission line and are operable to move said tuning stub along said path to change the length of said stub and operably tune said transmission line.

6. The miniature, electrostatically actuated, tunable circuit of claim 5 in which said tuning stub means includes a first stub that is fixed in position relative to said transmission line and a second stub that is movable along the top surface of said fixed stub and relative to said transmission line to change the length of said tuning stub means.

7. The miniature, electrostatically actuated, tunable circuit of claim 6 in which said fixed stub is connected to one side of said transmission line and projects therefrom at an angle.

8. The miniature, electrostatically actuated, tunable circuit of claim 6 in which said tuning stub means includes two spaced apart tuning stub means, each disposed at a separate location along said transmission line.

9. The miniature, electrostatically actuated, tunable circuit of claim in which said control means includes a plurality of individual control electrodes, each of said control electrodes including members which overlap the top and the bottom faces of said tuning stub means to effect electrostatic attraction between said control electrode and said tuning stub means and to allow said tuning stub means to move through the space between said members.

10. The miniature, electrostatically actuated, tunable circuit of claim 6 in which said fixed stub is spaced from said transmission line.

11. The miniature, electrostatically actuated, tunable circuit of claim 1 in which said tuning stub is elongate and is disposed generally parallel to said one surface of said substrate.

12. The miniature, electrostatically actuated, tunable circuit of claim 6 in which said movable second tuning stub includes a plurality of spaced apart tabs projecting from each side wall thereof, said tabs being operably electrostatically attracted by the electrostatic fields produced by said control electrodes.

13. The miniature, electrostatically actuated, tunable circuit of claim 3 in which said control means is disposed in spaced apart paths along each side of said transmission line.

14. The miniature, electrostatically actuated, tunable circuit of claim 12 in which a long axis of said tuning stub is disposed across said transmission line.

15. The miniature, electrostatically actuated, tunable circuit of claim 1 in which said tuning stub is fabricated of thin films.

16. The miniature, electrostatically actuated, tunable circuit of claim 1 in which said control means are fabricated of thin films.

17. The miniature, electrostatically actuated, tunable circuit of claim 1 in which said substrate is a material from the group consisting of gallium-arsenide, indium phosphide, and sapphire.

18. The miniature, electrostatically actuated, tunable circuit of claim 1 in which said tuning stub means comprises a layer of gold.

19. The miniature, electrostatically actuated, tunable circuit of claim 1 in which said control means comprises a layer of gold.

20. The miniature, electrostatically actuated, tunable circuit of claim 1 in which said transmission line, said tuning stub means, and said control means comprise a thin layer of titanium and gold and a thicker layer of gold.

21. A miniature, electrostatically actuated, circuit element comprising:

a substrate having a first circuit element fixed thereto;

a second circuit element having at least one stub which is movable relative to said first circuit element; and control means including control electrodes each having members that are disposed to overlap the top and the bottom faces of the movable stub of said second circuit element with an air gap there between and to allow said movable stub of said second circuit element to move through the space between said members and to operably effect electrostatic attraction between said second circuit element and said control in response to a control signal applied to said control electrode.

* * * * *

UNITED STATES PATENT AND TRADEMARK OFFICE

CERTIFICATE OF CORRECTION

PATENT NO. : 5,164,688

DATED : November 17, 1992

INVENTOR(S) : L. E. Larson

It is certified that error appears in the above-identified patent and that said Letters Patent is hereby corrected as shown below:

Column 9:

In Claim 9, line 17, after "claim" insert --1--; and

Column 10:

In Claim 21, line 39, after the first occurrence of "control" insert --electrode--.

Signed and Sealed this

Twenty-second Day of November, 1994

*Attest:*

Bruce Lehman

BRUCE LEHMAN

*Attesting Officer*

*Commissioner of Patents and Trademarks*